US009995440B2

(12) United States Patent
Edwards

(10) Patent No.: US 9,995,440 B2
(45) Date of Patent: Jun. 12, 2018

(54) COLOR TEMPERATURE TUNABLE AND DIMMABLE SOLID-STATE LINEAR LIGHTING ARRANGEMENTS

(71) Applicant: Intematix Corporation, Fremont, CA (US)

(72) Inventor: Charles Edwards, Pleasanton, CA (US)

(73) Assignee: Intematix Corporation, Fremont, CA (US)

( * ) Notice: Subject to any disclaimer, the term of this patent is extended or adjusted under 35 U.S.C. 154(b) by 0 days. days.

(21) Appl. No.: 14/963,176

(22) Filed: Dec. 8, 2015

(65) Prior Publication Data

US 2016/0186968 A1 Jun. 30, 2016

Related U.S. Application Data

(60) Provisional application No. 62/089,204, filed on Dec. 8, 2014.

(51) Int. Cl.

| | |
|---|---|
| ***F21V 9/16*** | (2006.01) |
| ***F21K 99/00*** | (2016.01) |
| ***F21K 9/64*** | (2016.01) |
| *F21Y 103/10* | (2016.01) |
| *F21Y 115/10* | (2016.01) |

(52) U.S. Cl.

CPC ..... *F21K 9/56* (2013.01); *F21K 9/64* (2016.08); *F21Y 2103/10* (2016.08); *F21Y 2115/10* (2016.08)

(58) Field of Classification Search

CPC ... F21K 9/098; F21K 9/10; F21K 9/16; F21K 9/64; F21V 3/0463; F21V 3/0481

USPC ..... 362/84, 230, 231, 246, 293

See application file for complete search history.

(56) References Cited

U.S. PATENT DOCUMENTS

| | | | | |
|---|---|---|---|---|
| 7,390,437 | B2 | 6/2008 | Dong et al. | |
| 7,902,560 | B2 | 3/2011 | Bierhuizen et al. | |
| 7,915,627 | B2 | 3/2011 | Li | |
| 8,294,074 | B2 | 10/2012 | Lyons et al. | |
| 8,449,129 | B2 | 5/2013 | Harbers et al. | |
| 8,783,901 | B2 * | 7/2014 | Zoorob ..... | F21K 9/00 257/103 |
| 2004/0222735 | A1 | 11/2004 | Ragle | |
| 2006/0109649 | A1 | 5/2006 | Ducharme et al. | |
| 2006/0158090 | A1 | 7/2006 | Wang et al. | |
| 2008/0111472 | A1 | 5/2008 | Liu et al. | |

(Continued)

FOREIGN PATENT DOCUMENTS

| | | | |
|---|---|---|---|
| EP | 2334147 | A2 | 6/2011 |
| WO | WO 2010074963 | A1 | 7/2010 |

OTHER PUBLICATIONS

Non-Final Office Action dated Dec. 30, 2016 for U.S. Appl. No. 13/273,199.

Final Office Action dated May 6, 2016 for U.S. Appl. No. 13/273,199.

Non-Final Office Action dated Jan. 20, 2016 for U.S. Appl. No. 13/273,199.

(Continued)

*Primary Examiner* — Elmito Breval

*Assistant Examiner* — Keith Delahoussaye

(74) *Attorney, Agent, or Firm* — Vista IP Law Group, LLP

(57) ABSTRACT

A solid-state linear lamp comprises a co-extruded component, the co-extruded component comprising multiple photoluminescence portions corresponding to different color temperatures, a diffuser portion, and a top portion, where the photoluminescence portion, the diffuser portion, and the top portion are integrally formed into the co-extruded component.

17 Claims, 12 Drawing Sheets

(56) References Cited

U.S. PATENT DOCUMENTS

| | | | | |
|---|---|---|---|---|
| 2009/0026913 | A1 | 1/2009 | Mrakovich | |
| 2009/0101930 | A1 | 4/2009 | Li | |
| 2009/0283721 | A1 | 11/2009 | Liu et al. | |
| 2010/0219767 | A1 | 9/2010 | Pumyea et al. | |
| 2010/0259917 | A1 | 10/2010 | Ramer et al. | |
| 2011/0050125 | A1 | 3/2011 | Medendorp et al. | |
| 2011/0121758 | A1 | 5/2011 | Bierhuizen et al. | |
| 2011/0133654 | A1 | 6/2011 | McKenzie et al. | |
| 2011/0176289 | A1 | 7/2011 | Ramer | |
| 2011/0241549 | A1 | 10/2011 | Wootton | |
| 2012/0147588 | A1 | 6/2012 | Yang | |
| 2013/0093362 | A1* | 4/2013 | Edwards | H01L 25/0753 315/313 |
| 2016/0018065 | A1* | 1/2016 | Schinagl | H01L 25/0753 362/608 |

OTHER PUBLICATIONS

Final Office Action dated Aug. 13, 2015 for U.S. Appl. No. 13/273,199.
Non-Final Office Action dated Dec. 31, 2014 for U.S. Appl. No. 13/273,199.
Final Office Action dated Aug. 25, 2014 for U.S. Appl. No. 13/273,199.
Non-Final Office Action dated Mar. 27, 2014 for U.S. Appl. No. 13/273,199.
International Search Report and Written Opinion dated Feb. 27, 2013 for PCT Appln. No. PCT/US2012/059288.
International Preliminary Report on Patentability dated Apr. 24, 2014 for PCT Appln. No. PCT/US2012/059288.

* cited by examiner

COLOR TEMPERATURE TUNABLE AND DIMMABLE SOLID-STATE LINEAR LIGHTING ARRANGEMENTS

CROSS-REFERENCE TO RELATED APPLICATIONS

This application claims the benefit of priority to U.S. Provisional Application No. 62/089,204, filed on Dec. 8, 2014, entitled "COLOR TEMPERATURE TUNABLE AND DIMMABLE SOLID-STATE LINEAR LIGHTING ARRANGEMENTS", which is hereby incorporated by reference in its entirety.

FIELD

This disclosure relates to solid-state linear lighting arrangements including light emitting phosphor and photoluminescence wavelength conversion components. More particularly, though not exclusively, embodiments of the invention are directed to linear lighting arrangements that are dimmable and color temperature tunable.

BACKGROUND

A common type of lighting apparatus that has achieved great commercial success is the linear lighting arrangement, in which the lighting apparatus typically has an elongated profile lamp with light emission along the length of the lamp. These linear lamps are commonly used in office, commercial, industrial and domestic applications and incorporate standard size linear lamps (such as standard tubular T5, T8, and T12 lamps).

A linear lighting apparatus that is commonly used in office and commercial applications is a ceiling-recess or troffer that is mounted within a modular suspended (dropped) ceiling. Other, linear lighting apparatus include suspended linear arrangements that can be direct only (downward light emitting) or direct/indirect (lighting both the workspace in a downward direction and the ceiling in an upward direction for indirect lighting. Surface mount linear fixtures, often called wraparound lights or wrap lights, are used in both office, industrial and domestic spaces. These are typically mounted directly to the surface of the ceiling or wall. Task lighting and under-cabinet fixtures also common use linear tubular lamps as the light source.

While traditional fluorescent tube troffers, suspended linear, wraparound lights and under-cabinet lighting arrangements are very common and exist in almost every commercial office building, there are many disadvantages associated with such lighting configurations. The conventional linear configurations tend to be relatively complex, given the number of disparate components (e.g., troffer housing, lamp connectors, lamp driver, separate diffusers, doors/panels, tubes) that need to be separately manufactured and then integrated together in the lighting arrangement. In addition, since each lamp (tube) requires electrical connection to each end, cabling has to be provided over a significant portion of the volume of the arrangement requiring greater and more extensive safety-related and certification-related reinforcements to the lighting fixture/troffer, increasing the size and weight of the arrangement. Moreover, fluorescent tubes in the conventional troffers suffer from spotty reliability and relatively inefficient lighting uniformity and performance. These problems therefore negatively affect the complexity, performance, weight, and/or cost to anyone that seeks to manufacture or install a linear light.

In addition, many disadvantages are also associated with the use of conventional fluorescent-based tube technology, which are gas discharge lamps that use electricity to excite mercury vapors. For example, the mercury within the fluorescent lamp is poisonous, and breakage of the fluorescent lamp, particularly in ducts or air passages, may require expensive cleanup efforts to remove the mercury (as recommended by the Environmental Protection Agency in the USA). Moreover, fluorescent lamps can be quite costly to manufacture, due in part to the requirement of using a ballast to regulate the current in such lamps. In addition, fluorescent lamps have fairly high defects rates and relatively short operating lives.

Recently, white light emitting LEDs ("white LEDs") have become more popular and more commonly used, replacing conventional fluorescent, compact fluorescent and incandescent light sources. White LEDs generally include one or more photo-luminescent materials (e.g., one or more phosphor materials), which absorb a portion of the radiation emitted by the LED and re-emit light of a different color (wavelength). The phosphor material may be provided as a layer on, or incorporated within a wavelength conversion component that is located remotely from the LED die. Typically, the LED generates blue light and the phosphor(s) absorbs a percentage of the blue light and re-emits yellow light or a combination of green and red light, green and yellow light, green and orange or yellow and red light. The portion of the blue light generated by the LED that is not absorbed by the phosphor material combined with the light emitted by the phosphor provides light which appears to the eye as being nearly white in color. Such white light LEDs are characterized by their long operating life expectancy (>50,000 hours) and high luminous efficacy (70 lumens per watt and higher).

For white LEDs, light is generated by two processes: electroluminescence and photoluminescence (rather than thermal radiation). Thus, the emitted radiation does not follow the form of a black-body spectrum. These sources are assigned what is known as a correlated color temperature (CCT). CCT is the color temperature of a black body radiator which to human color perception most closely matches the light from the lamp. Color temperature is a characteristic of visible light that has important applications in lighting. The color temperature of a light source is a measurement of the hue generated by that light source that corresponds to the temperature of an ideal black-body radiator that radiates light of comparable hue. Color temperature is conventionally stated in the unit of absolute temperature, the kelvin, having the unit symbol K. Color temperatures over 5,000 K are called cool colors (blueish white), while lower color temperatures (2,700-3,000 K) are called warm colors (yellowish white through red)

Traditional incandescent light bulbs are configured to generate light of varying brightness during dimming operation. A dimmer switch typically controls the power provided to the light bulb. The larger the power provided to the light bulb, the greater the temperature of the light bulb filament and the brighter the light generated. For an incandescent light bulb, light is generated by thermal radiation and so its color temperature is essentially the temperature of the filament. Typical incandescent light bulbs generate light of a warm yellowish white hue (e.g., 2,700-3,000K) at full power and at lower powers, can produce light of an even warmer orangeish white hue (e.g., 1500K) that is not available in non-incandescent light bulbs.

Whereas some incandescent light bulbs are capable of generating light that ranges from a warm yellowish white to a warmer orangeish white, white LED light emitting devices (e.g., LED-based linear lamps) do not exhibit these same characteristics. This is because the color temperature of an incandescent light bulb changes in response to the power provided to the bulb, whereas the correlated color temperature (CCT) of a white LED light emitting device changes in response to variations in photo-luminescent material or the material from which the LED is fabricated. Because the photo-luminescent materials and LED materials are fixed, when the power applied to the white LED light emitting device is lowered, the intensity of the emission product changes, but the correlated color temperature remains the same.

Thus, a problem with such devices involves the dimming/correlated color temperature (CCT) characteristics of such devices. Moreover, while some incandescent lights may be capable of generating light with a range of color temperatures between warm yellowish white and even warmer orangeish white, it may be desirable to have an even larger range of color temperatures. For example, a restaurant may want to tune a light bulb to generate bright bluish white light for large parties to create an exciting atmosphere and softer yellowish white light for intimate gatherings to create a warm and romantic atmosphere.

As is evident, there is a need for an improved approach to implement linear lighting arrangements that overcome the drawbacks of the conventional linear lamps.

SUMMARY OF THE INVENTION

Embodiments of the invention concern an integrated lighting component and an improved color temperature controllable linear lighting arrangement and arrangements that can control color temperature as the lighting arrangement is dimmed.

According to some embodiments, the light arrangement comprises an elongate solid-state light source having multiple elongate arrays of solid-state light emitters and an elongate optical component, wherein the elongate optical component comprises multiple wavelength conversion regions having a first region that corresponds to a first color temperature and a second region that corresponds to a second color temperature. The first region corresponds to a first elongate array of solid-state light emitters and the second region corresponds to a second elongate array of solid-state light emitters. In some embodiments, the LEDs in a given array generates blue light of the same wavelength. The optical component may be formed as a co-extruded hollow integrated component. The multiple wavelength conversion regions may project into the interior of the optical component, and the optical component may include a diffuser portion having a light diffusive material.

Some embodiments comprise a control circuit to control distribution of power to the multiple elongate arrays of solid-state light emitters. The control circuit may include a dimmer switch and a color temperature control circuit. In one approach, the dimmer switch and the color temperature control circuit correspond to separate control mechanisms. Alternatively, a single control mechanism is provided that controls both the dimmer switch and the color temperature control circuit.

The multiple elongate arrays of solid-state light emitters are arranged such that a first set of the solid-state light emitters correspond to the first region and a second set of the solid-state light emitters correspond to the second region. An on/off arrangement can be provided for the multiple elongate arrays of solid-state light emitters that includes turning off a portion of the first set of the solid-state light emitters and leaving on all of the second set of the solid-state light emitters.

In some embodiments, the first region multiple wavelength conversion regions is located at the center of the elongate optical component and the second region comprises two regions that surround the first region (i.e. adjacent to). The light generated by the first region may have a lower color temperature such as warm white and light generated by the second region(s) may have a higher color temperature such as cool white. The first region that is warm white correspond to a yellowish to orange white color and the second region that is cool white corresponds to a bluish white color. The CCT of the emission product of the light arrangement is a combination of a CCT of light generated by the elongate solid-state light source, a CCT of light generated by the first region, and a CCT of light generated by the second region.

BRIEF DESCRIPTION OF THE DRAWINGS

In order that the present invention is better understood LED-based linear lighting devices and photoluminescence wavelength conversion components in accordance with the invention will now be described, by way of example only, with reference to the accompanying drawings in which like reference numerals are used to denote like parts, and in which.

DETAILED DESCRIPTION OF THE INVENTION

Embodiments of the present invention pertain to linear lamps that utilize solid-state light emitting devices, typically LEDs (Light Emitting Diodes) in combination with an integrated wavelength conversion component, where the linear lamp is dimmable and/or color temperature tunable.

According to some embodiments, the embodiments of the invention pertains to a linear lighting arrangements having two different colors of remote phosphor that will allow color temperature control and/or color temperature control with dimming, where the linear lighting arrangement comprises an integrated wavelength conversion for remote phosphor lighting applications that is formed using extrusion. Located under each color of remote phosphor are separate LED arrays which enable the arrangement to generate light which can be either color or by a mix of the combined colors.

One possible use of this technology is to implement "warm dimming". This is when during certain tasks, high brightness cool white (like 4000K) may be used (e.g., in a kitchen while cooking, or hotel during daytime working hours), but at other times a dimmer, warmer ambience is desired (e.g., in the kitchen when serving a nice dinner or hotel for an evening event). Dimmed light that is very warm white (e.g., 2400K and even lower) is often desired to give a very warm hue. Known linear LED-based lamps at all lumen levels stay at the same color temp (K), and so are not capable of providing this functionality. However, the embodiments of the present invention provide at least two remote phosphor sources that can be tuned to be close to or on the black body curve, allowing a blend of these the colors to be very stable and where the blending at different relative levels lies along an approximately straight line connecting the cool and warm white points. The arrangement is configured such that such a light approximates to the black body curve. This allows both dimming and corresponding color temperatures to be tuned at the different dimming levels.

The embodiments of the invention are applicable to any type of linear lighting arrangement, including troffer-based arrangements, surface mount linear fixtures, task lighting, and under-cabinet fixtures. For the purposes of illustration, the below description will provide an explanation of certain embodiments in the context of surface mount linear fixtures. However, it is noted that the inventive concepts disclosed herein are equally applicable to other types of linear lighting devices.

Figure 1A:
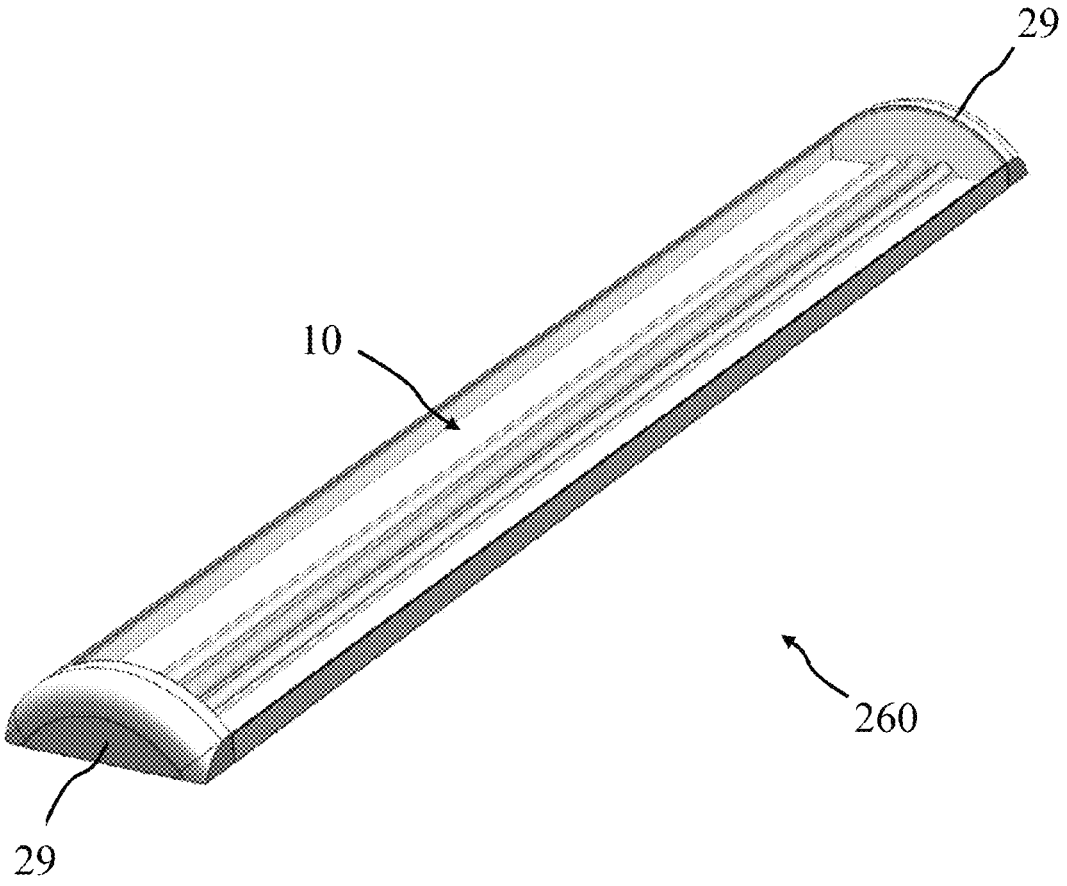
FIGS. 1A and 1B respectively illustrate perspective and exploded views of a surface mountable wraparound linear lamp.
Figure 1B:
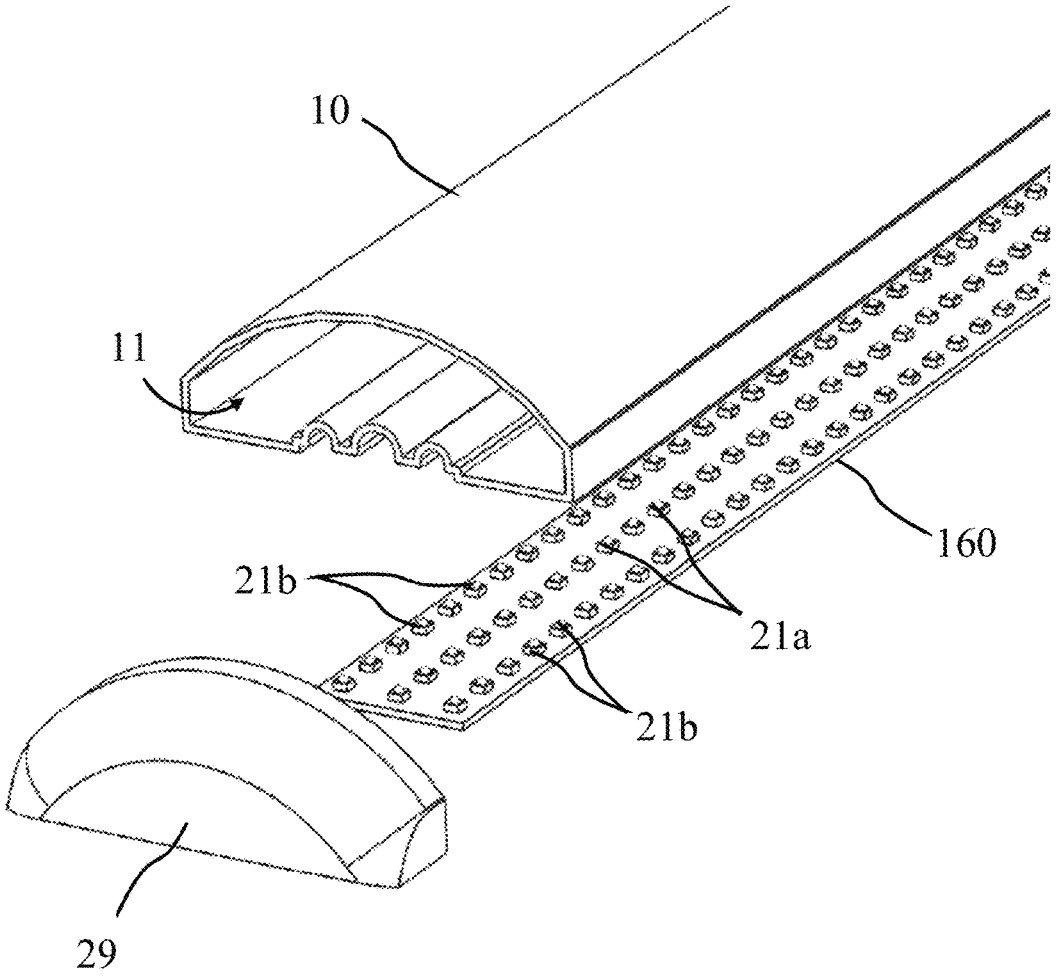
Figure 1C:
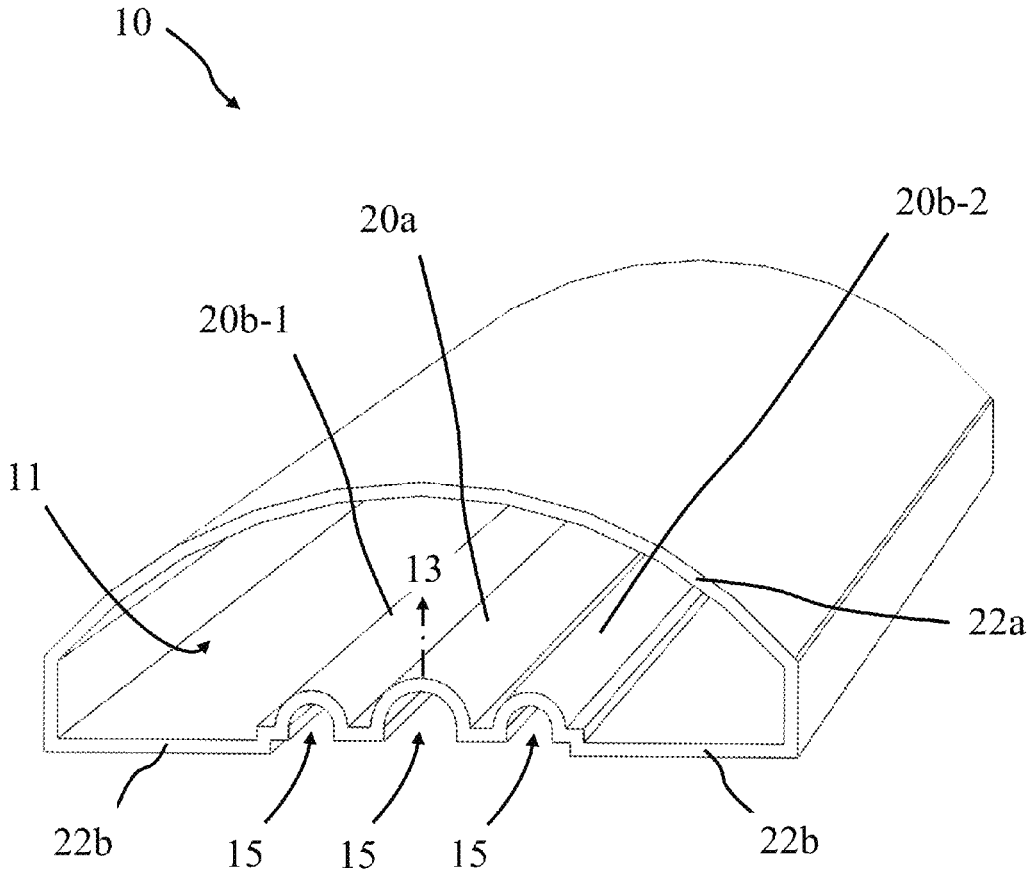
FIG. 1C illustrates a perspective view of a wavelength conversion component for a surface mountable wraparound linear lamp.

FIGS. 1A-C illustrate a surface mountable wraparound linear lighting arrangement 260 according to embodiments of the invention. The surface mountable lighting arrangement 260 includes a hollow integrated wavelength conversion component 10 and a substrate 160 having multiple arrays of LEDs 21. For linear applications, the wavelength conversion component 10 and the substrate 160 having the LEDs 21 are elongated components. The integrated wavelength conversion component 10 includes multiple wavelength conversion regions with different photo-luminescent materials (e.g., for a first light emission color, more typically first color temperature), including a central wavelength conversion portion 20*a* having a first photo-luminescent material and one or more other outer wavelength conversion portions 20*b*-1 and 20*b*-2 that correspond to a different photo-luminescent material (e.g., for a second light emission color, more typically a second color temperature). The wavelength conversion portions 20*a*, 20*b*-1, and 20*b*-2 comprise photoluminescence materials which absorb a portion of the excitation light emitted by the LEDs 21 and re-emit light of a different color. The substrate 160 comprises separate arrays of LEDs 21, where each array of LEDs 21*a*, 21*b* correspond to each respective one of the different wavelength conversion portions 20*a*, 20*b*-1, and 20*b*-2.

A dimmer switch may be provided that is configured to generate a range of output powers for the linear lighting arrangement 260, where a control circuit configured to translate output power generated by the dimmer switch into corresponding power for the plurality of LEDs 21*a*, 21*b*. As noted above, the wavelength conversion component 10 has at least two or more regions with different photo-luminescent materials located remotely to a respective array of solid-state light sources and operable to convert at least a portion of the light generated by the plurality of solid-state light sources to light of a different wavelength, wherein the emission product of the device comprises combined light generated by the plurality of light sources and the two or more regions of the wavelength conversion component. By differentially controlling the power to each of the different regions, the linear lighting arrangement 260 can be dimmablely controlled while also being able to control the color temperature of the final light product from the linear lighting arrangement 260.

The integrated wavelength conversion component 10 includes one or more photoluminescence materials (e.g., phosphor materials) which absorb a portion of the excitation light emitted by the LEDs 21*a*, 21*b* and re-emit light of a different color (wavelength). In some embodiments, the LED chips generate blue light and the phosphor(s) absorbs a percentage of the blue light and re-emits yellow light or a combination of green and red light, green and yellow light, green and orange or yellow and red light. The portion of the blue light generated by the LED that is not absorbed by the phosphor material combined with the light emitted by the phosphor provides light which appears to the eye as being nearly white in color. Alternatively, the LED chips may generate ultraviolet (UV) light, in which phosphor(s) absorb the UV light to re-emit a combination of different colors of photoluminescence light that appear white to the human eye. As is evident, the invention may be practiced using any combination of LEDs 21 that produce different colors of light. For example, another embodiment may include an array of LEDs 21 that comprise both blue LEDs and red LEDs. In some embodiments, each array includes LEDs each of which generates substantially the same blue light.

The integrated wavelength conversion component 10 includes a first portion 22*a* and a second portion 22*b*. In some embodiment, instead of requiring a separate diffuser to be individually sourced and then added to the arrangement, the integrated wavelength conversion component 10 includes diffuser materials that are integrally formed or included into portion 22*a*. A reflector may be integrally formed into or applied to portion 22*b*.

In some embodiments, the substrate 160 comprises an elongated strip of MCPCB (Metal Core Printed Circuit Board). As is known a MCPCB comprises a layered structure composed of a metal core base, typically aluminum, a thermally conducting/electrically insulating dielectric layer and a copper circuit layer for electrically connecting electrical components in a desired circuit configuration. The metal core base of the circuit board 160 can be mounted in thermal communication with a heat sink, e.g., with the aid of a thermally conducting compound such as for example a material containing a standard heat sink compound containing beryllium oxide or aluminum nitride. The heat sink is made of a material with a high thermal conductivity (typically $\geq 150\ Wm^{-1}K^{-1}$, preferably $\geq 200\ Wm^{-1}K^{-1}$) such as for example aluminum ($\approx 250\ Wm^{-1}K^{-1}$), an alloy of aluminum, a magnesium alloy, a metal loaded plastics material such as a polymer, for example an epoxy. The heat sink can be manufactured using any suitable manufacturing process, e.g., extruded, die cast (e.g., when it comprises a metal alloy), extruded, and/or molded, by for example injection molding (e.g., when it comprises a metal loaded polymer).

One or more array of solid-state light emitters (e.g., LEDs 21) are mounted on the circuit board 160. Each solid-state light emitter 21 can comprise a gallium nitride-based blue light emitting LED operable to generate blue light with a dominant wavelength of 455 nm-465 nm. The LEDs 21 can be configured as an array, e.g., in a linear array and/or oriented such that their principle emission axis is orthogonal to the longitudinal axis of the circuit board 160.

The integrated wavelength conversion component 10 is formed as an integrated structure that includes different portions having different physical and/or optical properties. In the embodiment of FIGS. 1A-C, the integrated wavelength component 10 includes a portion 22*a*, a portion 22*b*, and wavelength conversion portions 20*a*, 20*b*-1, 20*b*-2. In the illustrated embodiment, the wavelength conversion component 10 comprises a profile formed as a continuous wall, where certain portions along the lengths of the wall correspond to the wavelength conversion portions, portion 22*a*, and portion 22*b*.

As discussed in more detail below, the wavelength conversion portions comprises one or more photoluminescence materials that produce photoluminescence light in response to excitation from LED light. The wavelength conversion portions are formed as regions of the wall length of the integrated wavelength conversion component 10 that projects into the interior volume 11 of the integrated wavelength conversion component 10. The wavelength conversion portions therefore forms projections in the projection direction 13. The shape of the wavelength conversion portions are configured to define open portions 15, sufficiently large enough to allow insertion of the arrays of LEDs 21 into the open portions 15.

The portion 22*b* is located along the bottom of the integrated wavelength conversion component 10, and comprises the wall lengths of the component 10 on either side of the wavelength conversion portions. Since the lighting arrangement 260 is intended for a surface mounted application, there is little or no need for light to be emitted from the portion 22*b* of the lamp 260. Therefore, the portion 22*b* of the component does not need to be formed of a clear material, but can instead be formed as a reflector portion. The reflector portion can comprise a light reflective material, e.g., a light reflective plastics material. Alternatively the reflector can comprise a metallic component or a component with a metallization surface.

The portion 22*a* can be implemented as an optically transparent substrate or lens through which light emitted by the wavelength conversion portions can be emitted in an outwards direction. In some embodiments, the portion 22*a* provides a diffuser that is integrated within the rest of the integrated wavelength conversion component 10. This means that the lighting arrangement does not need to include any other separate diffuser in order to diffuse the light that is emitted from the wavelength conversion portions. The diffuser portion 22*a* can be configured to include light diffusive (scattering) material. Example of light diffusive materials include particles of Zinc Oxide (ZnO), titanium dioxide ($TiO_2$), barium sulfate ($BaSO_4$), magnesium oxide (MgO), silicon dioxide ($SiO_2$) or aluminum oxide ($Al_2O_3$). A description of scattering particles that can be used in conjunction with the present invention is provided in U.S. application Ser. No. 14/213,096, filed on Mar. 14, 2014, entitled "DIFFUSER COMPONENT HAVING SCATTERING PARTICLES", which is hereby incorporated by reference in its entirety.

One advantage provided by having the portion 22*a* is that this provides a sealed top to the lamp, which avoids a "bug trap" or "debris trap" problem of having unsightly contaminants intrude within the interior volume 11 of the lamp. In some embodiments, the entire surface of the integrated wavelength conversion component 10 (except for the ends) is formed as a closed surface. Alternatively, a substantial portion of the surface is closed (rather than the entirety of the surface) where openings may be formed in the surface of the integrated wavelength conversion component 10, e.g., where small openings are provided to allow heat exchange from the interior of the component 10.

The wavelength conversion portions can be formed of and/or include any suitable photoluminescence material(s). In some embodiments, the photoluminescence materials comprise phosphors. For the purposes of illustration only, the following description is made with reference to photoluminescence materials embodied specifically as phosphor materials. However, the invention is applicable to any type of photoluminescence material, such as either phosphor materials or quantum dots. A quantum dot is a portion of matter (e.g. semiconductor) whose excitons are confined in all three spatial dimensions that may be excited by radiation energy to emit light of a particular wavelength or range of wavelengths.

It is noted that the integrated nature of the integrated wavelength conversion component 10 provides numerous advantages. Integrating the wavelength conversion components with an enclosure having other portions (such as the diffuser portion 22*a*) that forms a unitary component avoids many problems associated with having them as separate components. With the present invention, the integrated component can be assembled without requiring components for these functional portions, and without requiring separate assembly actions to place them into a lighting arrangement. In addition, significant material cost savings can be achieved with the present invention. The overall cost of the integrated component is generally less expensive to manufacture as compared to the combined costs of having a separate wavelength conversion component and a separate diffuser component. In addition, separate packaging costs would also exist for the separate component. Moreover, an organization may incur additional administrative costs to identify and source the separate components. By providing an integrated component that integrates the different portions together, many of these additional costs can be avoided. However, in some alternate embodiments, the component 10 does not need to be manufactured as an integrated component. For example, the wavelength conversion components may be separately manufactured, and then affixed to a hollow component having only portions 22*a* and 22*b*. In this approach, the hollow component may provide an opening at the center top surface or it may alternatively have a closed surface at the top.

A co-extrusion approach can be employed to manufacture the integrated component 10. Each of the portion 22*b*, wavelength conversion components, and portion 22*a* are co-extruded using respective materials appropriate for that portion of the integrated component. For example, the wavelength conversion portions are co-extruded using a base material having photoluminescence materials embedded therein. The diffuser portion 22*a* can be co-extruded to include diffusion particles. The portion 22*b* can be co-extruded using any suitable material, e.g., a light transmissive thermoplastic by itself or thermoplastics that includes light reflective materials embedded therein.

A multi-extrusion process can be utilized to manufacture the integrated component 10, where separate extruders are used to feed into a single tool to create the layers of phosphor portion, the materials of the top portion, and the material of the diffuser portion. The multiple layers are simultaneously created and manufactured together in this approach.

Figure 2:
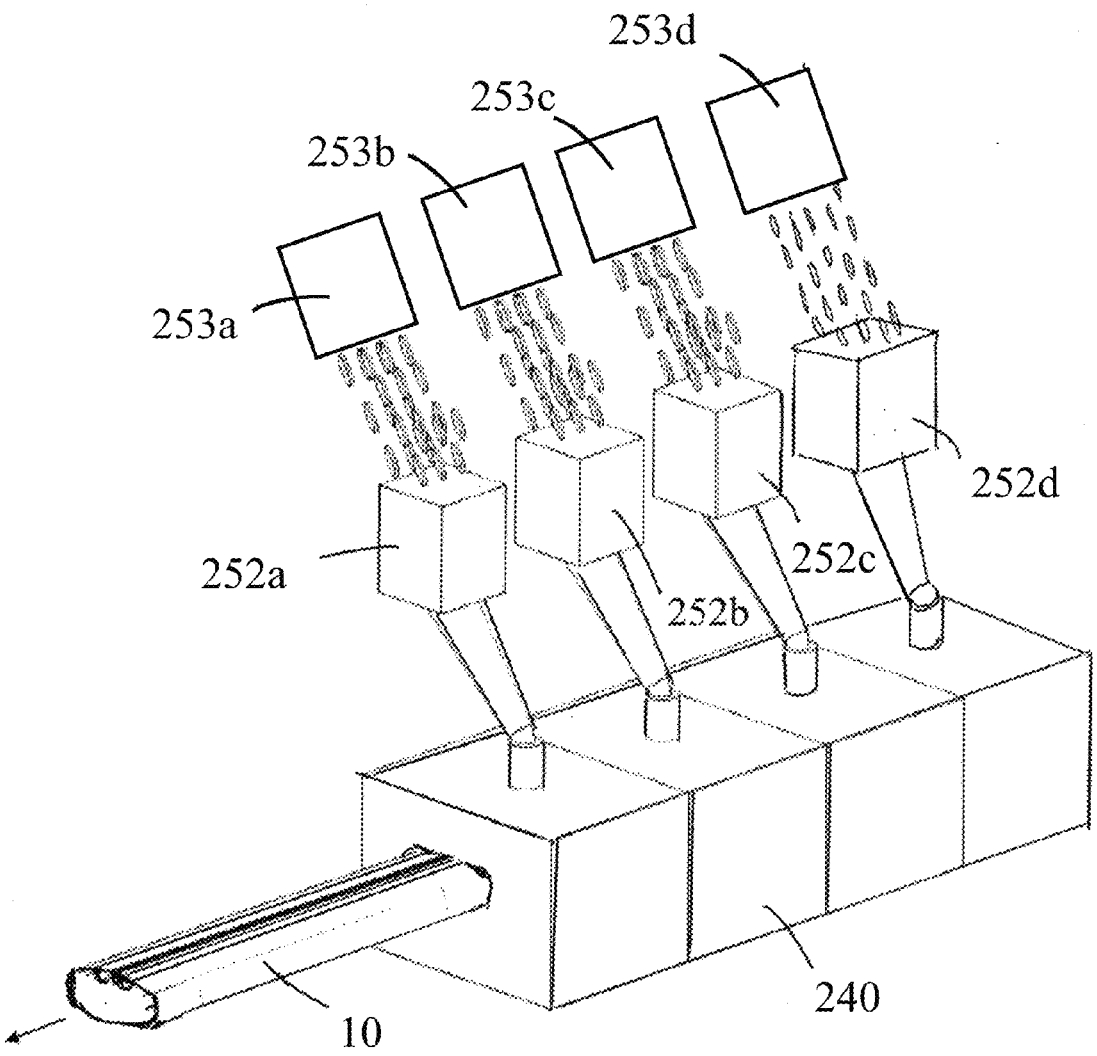
FIG. 2 illustrates an approach to extrude an integrated wavelength conversion component.

FIG. 2 illustrates a process for co-extruding the integrated wavelength conversion component 10. In this approach, multiple extruders 252*a-d* feed into a single extrusion head 254 to create the integrated wavelength conversion component 10. This approach can be used with a wide variety of source materials, e.g. PC-Polycarbonate, PMMA-Poly (methyl methacrylate), and PET-Polyethylene Terephthalate, including most or all thermoform plastics. This co-extrusion process can generally use pellets identical or similar to pellets used for injection molding materials.

A first extruder 252*a* processes the material 253*a* for the diffuser portion 22*a* of the integrated wavelength conversion component 10. As previously noted, a light diffusing/scattering material can be incorporated into the material to form the diffuser portion. Therefore, the first extruder 252*a* can be used to process a polymer material 253*a* that includes the light diffusing/scattering material. In some embodiments, the light reflective material comprises titanium dioxide ($TiO_2$) though it can comprise other materials such as barium sulfate ($BaSO_4$), magnesium oxide (MgO), silicon dioxide ($SiO_2$) or aluminum oxide ($Al_2O_3$).

A second extruder 252*b* processes the material 263*b* for the portion 22*b* of the integrated wavelength conversion component 10. The second extruder 252*b* is used to process either a clear solid material (e.g., clear polymer) or reflective materials.

A third extruder 252*c* processes the material 253*c* for the central phosphor portion 20*a* of the integrated wavelength conversion component 10. Therefore, the third extruder 252*b* can be used to process a polymer material that also includes the phosphor material.

A fourth extruder 252*d* processes the material 253*d* for the side phosphor portions 20*b*-1 and 20*b*-2 of the integrated wavelength conversion component 10. Therefore, the fourth extruder 252*b* can be used to process a polymer material that also includes the phosphor material.

The extruders 252*a*-*d* are used to feed their respective materials 253*a*-*d* into a single extruder head 254 to create the multiple portions of materials in the integrated wavelength conversion component 10. The final product is the integrated wavelength conversion component 10, where the various phosphor portions 20*a*, 20*b*-1, 20*b*-2, diffuser portion 22*a*, and portion 22*b* are shaped as illustrated in FIGS. 1A-C.

In some embodiments, a heat sink can be integrally formed into the integrated wavelength conversion component 10. In this approach, material for the heat sink is provided to the extrusion head by a separate extruder, and the heat sink material is used to extrude the portion of the component 10 adjacent to the intended location of the circuit board having the LEDs. Any suitable material may be used as the heat sink material, so long as the material has sufficient thermal conductance properties adequate to handle the amounts of heat to be generated by the specific lighting application/configuration to which the invention is directed. For example, thermally conductive plastics or polymers having thermally conductive additives may be used as the source material for the extruder that forms the heat sink portion of the component 10. The integrally formed heat sink may be used to avoid the need to add an external heat sink during the manufacturing process for the lamp. Alternatively, the integrally formed heat sink may be used in conjunction with an external heat sink.

Different types of extrusion processes may be used to manufacture the integrated wavelength conversion component 10. In some embodiments, a vacuum extrusion approach is performed to manufacture the integrated wavelength conversion component 10. The vacuum extrusion approach is preferable when manufacturing the embodiments that do not include any protrusions that extend from the surface of the integrated wavelength conversion component 10.

The lighting arrangement 260 may include includes wavelength conversion component end caps 29, substrate 160, a heat sink, and a mounting plate. The substrate 160 contains multiple arrays of LEDs 21 and is affixed to the heat sink. The mounting plate is used to mount the lighting arrangement 260 to a ceiling, e.g., using fixing screws. The mounting plate can be formed of any suitable material such as an extruded aluminum section or an extruded thermoplastics material.

As previously noted, the drawback with conventional LED-based linear lamps is that they suffer from undesirable dimming characteristics for certain lighting applications. Whereas some incandescent light bulbs are capable of generating light that ranges from a warm yellowish white to a warmer orangeish white, the typical LED-based linear lamp does not exhibit these same characteristics. This is because the color temperature of an incandescent light bulb changes in response to the power provided to the bulb whereas the correlated color temperature (CCT) of a typical LED-based linear lamp changes in response to variations in photo-luminescent material of the wavelength conversion component. Because the photo-luminescent material of the wavelength conversion component is fixed, when the output power of the LEDs in a typical LED-based linear lamp is lowered, the intensity of the emission product changes, but the correlated color temperature remains the same. Thus, rather than seeing the CCT of the device vary from a warm yellowish white color to a warmer orangeish white color as output power to the LEDs is lowered, the CCT varies from an intense blueish white to a less intense blueish white. For certain applications, this type of color variation with respect to output power is undesirable. Instead, a color variation that more closely resembles that of the dimmable incandescent light bulb described above may be desired.

Figure 3A:
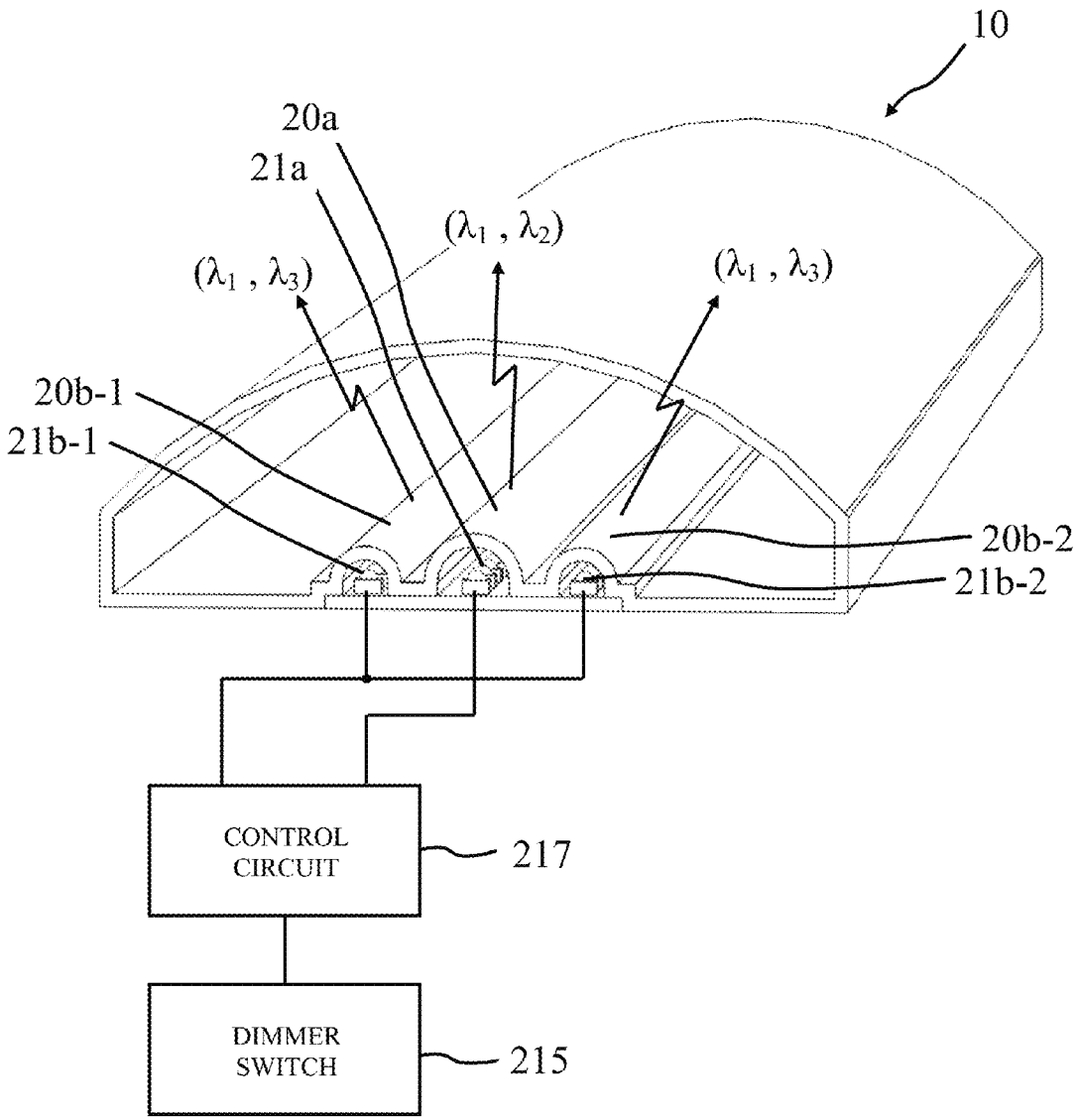
FIGS. 3A-B illustrate a linear lighting device having control circuitry to dimmably adjust the linear lighting device in conjunction with adjustments to its color temperature.

FIG. 3A illustrates a tunable light emitting linear device that utilizes remote wavelength conversion in accordance with some embodiments. The device comprises a wavelength conversion component 10 having different wavelength conversion portions 20*a*, 20*b*-1, 20*b*-2, as described above with respect to FIGS. 1A-C. The device may further comprise a plurality of arrays of blue light emitting LEDs (blue LEDs) 21*b*-1, 21*a*, and 21*b*-2 that correspond to wavelength conversion portions 20*a*, 20*b*-1, 20*b*-2, respectively. Typically, the LEDs comprise a light emitting diode (LED) such as an InGaN/GaN (indium gallium nitride/gallium nitride) based LED chip which is operable to generate blue light of wavelength 400 to 465 nm.

The wavelength conversion portions 20*a*, 20*b*-1, 20*b*-2 are positioned remotely to the plurality of arrays of blue light emitting LEDs (blue LEDs) 21*b*-1, 21*a*, and 21*b*-2. The wavelength conversion component 10 comprises a first portion 20*a* composed of a first photo-luminescent material and one or more second portions 20*b*-1, 20*b*-2 composed of a second photo-luminescent material.

In some embodiments, the first portion 20*a* may be located at the center of the wavelength conversion component 10 and the second portions 20*b*-1, 20*b*-2 may be located on either side of the first portion 20*a*. Such a configuration is preferred for direct lighting arrangements in which a user may directly view the lighting arrangement. In some other embodiments, the wavelength conversion component may only include one region for the second portion, where the first and second portions are side-by-side. Such a configuration is less expensive since it requires fewer LEDs (one less array) and would find particular utility in indirect lighting applications.

In some embodiments the LEDs may be arranged such that a first set of LEDs 21*a* correspond to the first portion 20*a* of the wavelength conversion component 10, set of LEDs 21*b*-1 correspond to portion 20*b*-1, and a set of LEDs 21*b*-2 correspond to a region 21*b*-2.

The wavelength conversion component is operable to absorb a proportion of the blue light $\lambda_1$ generated by the LEDs and convert it to light of a different wavelength by a process of photoluminescence (e.g., first portion converts light to $\lambda_2$ and the one or more second portions converts light to $\lambda_3$). Not all of the blue light $\lambda_1$ generated by the LEDs is absorbed by the wavelength conversion component, and some of it is emitted through 22*a*. The emission product of the device thus comprises the combined light of wavelengths $\lambda_1$, $\lambda_2$, $\lambda_3$ generated by the LEDs and a first region (portion 20*a*) and one or more second regions (portions 20*b*-1, 20*b*-2) of the wavelength conversion component 10. Thus, light of wavelength $\lambda_2$ is generated by the first region (portion 20*a*) and light of wavelength $\lambda_3$ is generated by the one or more second regions (portions 20*b*-1, 20*b*-2). The CCT of the emission product from the device is a combination of the CCT of the light generated by the LED ($\lambda_1$), the CCT of the light ($\alpha_2$) generated by the first region, and the CCT of the light ($\alpha_3$) generated by the second region.

In some embodiments, the first region 20*a* (20*b*-1, 20*b*-2) of the wavelength conversion component may include photo-luminescent material that generates light ($\alpha_2$) with a CCT corresponding to a warm yellow-orangeish white and the second region (20*b*-1, 20*b*-2) of the wavelength conversion component may include photo-luminescent material that generates light ($\alpha_3$) with a CCT corresponding to a cool blueish white. The emission product of the device in this example would be a combination of the warm yellowish white light generated by the first region, the cool blueish white light generated by the second region, and the blue light generated by the LEDs.

A dimmer switch 215 may be operably connected to a control circuit 217 which is operably connected to the plurality of LEDs. The dimmer switch 215 is configured to generate a continuous range of output powers to be used for tuning the light emitting device. The control circuit 217 is configured to translate the generated output power into an on/off arrangement and/or adjustable power arrangement for the plurality of LEDs.

While the variation in color temperature of an incandescent light bulb is directly related to the output power of the dimmer switch, the CCT of the emission product of the light emitting device is not directly related to the output power of the dimmer switch 215. As such, the control circuit 217 translates the output power of the dimmer switch 215 into a control arrangement for the plurality of LEDs 21 such that the device dimming behavior resembles that of the dimmable incandescent light bulb described above.

Because the emission product of the device is a combination of light ($\lambda_1$) generated by the LEDs and light ($\lambda_2$, $\lambda_3$) generated by the first and second regions of the wavelength conversion component, the CCT of the emission product can be changed by modifying the combination of light. Furthering the example discussed above, a CCT corresponding to a warm yellowish white color may be generated by having a larger portion of the emission product emanate from the first region (e.g., region generating light with a CCT corresponding to a warm yellow-orange white) and a smaller portion of the emission product emanate from the second region (e.g., region generating light with a CCT corresponding to a cool blueish white). A CCT corresponding to a cool bluish white color may be generated by having a smaller portion of the emission product emanate from the first region and a larger portion of the emission product emanate from the second region.

Because the composition, size, and location of the first region and the second region of the wavelength conversion component are fixed, the combination of the emission product may be modified, for example, by altering the drive currents of the LED arrays. Thus, the CCT of the emission product may grow closer to a warm yellowish color as the second array of LEDs corresponding to the second region of the wavelength conversion component are turned off while the first set of LEDs corresponding to the first region of the wavelength conversion component remain on. In some embodiments, the CCT of the emission product may correspond to a cool bluish white color when the entirety of the plurality of LEDs is turned on and shift towards a warm yellowish white color as the second set of LEDs corresponding to the second region (e.g., region generating light with a CCT corresponding to a cool blueish white) of the wavelength conversion component are turned off.

The CCT of the emission product may also shift from a warm yellowish white color to a cool bluish white color as the second set of LEDs corresponding to the second region of the wavelength conversion component are turned on. In some embodiments, the CCT of the emission product may correspond to a warm yellowish white color when only the first set of LEDs corresponding to the first region (e.g., region generating light with a CCT corresponding to a warm yellowish white) is turned on and shift towards a cool bluish white color as the second set of LEDs corresponding to the second region (e.g., region generating light with a CCT corresponding to a cool blueish white) of the wavelength conversion component are turned on.

Thus by configuring the control circuit 217 of the light emitting device to translate output power of the dimmer switch 215 into a corresponding on/off configuration of the plurality of LEDs, the light emitting device may be tuned like a typical incandescent light bulb, while also providing a significantly larger CCT range for the emission product when compared to a typical incandescent light bulb.

Alternatively, instead of an on/off control, individual power levels are adjusted by control circuit 217 to the different arrays of LEDs, so that a selected ratio of the emissions from the different regions is obtained to obtain a desired CCT of the emission product. In this approach, the CCT of the emission product correspond to a cool bluish white color or a warm yellowish white color depending upon the relative amounts of power that are provided to the first set of LEDs and the second set of LEDs.

There are numerous approaches that can be taken to control the color temperature of the linear light emitting arrangement. In the embodiment of FIG. 3A, operation of the dimmer switch 215 will automatically change the color temperature of the light emitting arrangement. The control circuit 217 can be configured, for example, to cause the light emitting arrangement provide a relatively cool color temperature when the light emitting device is set at the brightest/brighter (high) power levels, while providing relatively warmer color temperatures as the light emitting device is dimmed to lower power levels. One way to implement this is to provide full power to all of the LEDs 21*a*, 21*b*-1, and 21*b*-2 at the highest lighting levels at the dimmer switch 215, where the full amount of light output from portion 20*a* (that emits cool white light) causes the final emission product to have a relatively cool color temperature. As the dimmer switch 215 is manipulated to dim the light output of the lighting device, less power is applied to the central LEDs

21*a*, causing relatively less of the final light output to be emitted from portion 20*a* (cool white light) and relatively more of the final light output to be emitted from portions 20*b*-1 and 20*b*-2 (warm white light), which causes the final emission product to have a relatively warmer color temperature.

In some embodiments, 100% utilization of all LEDs is implemented at a full "on" position for the dimmer switch (both warm and cool are on at same time). Various percentages of the LEDs can be turned on/off for the different warm white settings, e.g., where 25% are on for a very warm white setting, such that a 4K lumen fixture would shift from 4000K CCT at full 40001 ms to 2200KCCT at >10001 ms. In some embodiments, the color range should range from 4000K to 2200K. In certain embodiments, slightly more LEDs can be wired in series in the cool white strings than the warm white strings, where the strings of cool white LEDs dim first (e.g., where they require a higher voltage to stay on) assuming all three strings of LEDs on the circuit board are hooked in parallel to the same power supply. In some embodiments, color targets can be set for the cool white and warm white where it is configured such that the cool white is never on alone (e.g., full on=75% cool white and 25% warm white).

Figure 3B:
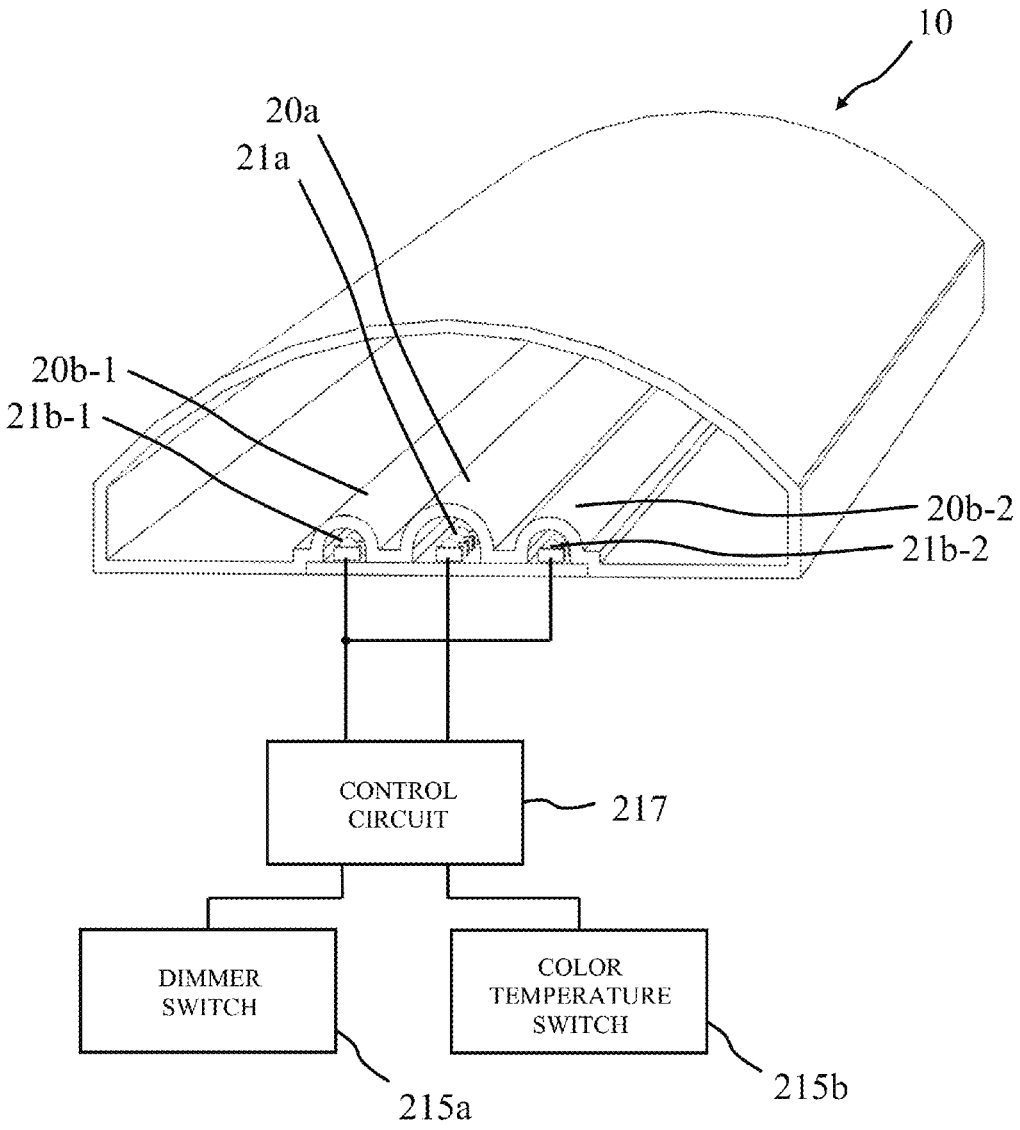

In the embodiment of FIG. 3B, independent controls can be applied to separately control both the dimming level of the lighting device as well as its color temperature. Here, operation of the dimmer switch 215*a* will not automatically change the color temperature of the lighting device. Instead, operation of the dimmer switch 215*a* will only change the overall amount of power to be collectively provided to the LEDs 21*a*, 21*b*-1, and 21*b*-2. The relative amount of power applied to each of the respective array of LEDs 21*a*, 21*b*-1, and 21*b*-2 is controlled by the color temperature switch 215*b*. Therefore, only the overall brightness of the light is controlled by dimmer switch 215*a*. The color temperature of the final light emission is controlled by the color temperature switch 215*b*, where a cooler light emission is produced by shifting a higher proportion/ratio of the power to the LEDs 21*a* that corresponds to portion 20*a* (cool white light) and shifting a lower proportion/ratio of the power to the LEDs 21*b*-1 and 21*b*-2 that corresponds to portions 20*b*-1 and 20*b*-1 (warm white light). On the other hand, a warmer light emission is produced by shifting a lower proportion/ratio of the power to the LEDs 21*a* that corresponds to portion 20*a* (cool white light) and shifting a higher proportion/ratio of the power to the LEDs 21*b*-1 and 21*b*-2 that corresponds to portions 20*b*-1 and 20*b*-1 (warm white light).

The embodiments of the present invention provide lighting devices that can be tuned to be close to or on the black body curve, since there at least two remote phosphor portions that act as emission sources allowing a blend of these the colors to be very stable. In some embodiments, the blending of the different colors are at different relative levels that lie along an approximately straight line connecting the cool and warm white points, such that the light emissions approximate to the black body curve. This allows both dimming and corresponding color temperatures to be tuned at the different dimming levels.

Figure 4:
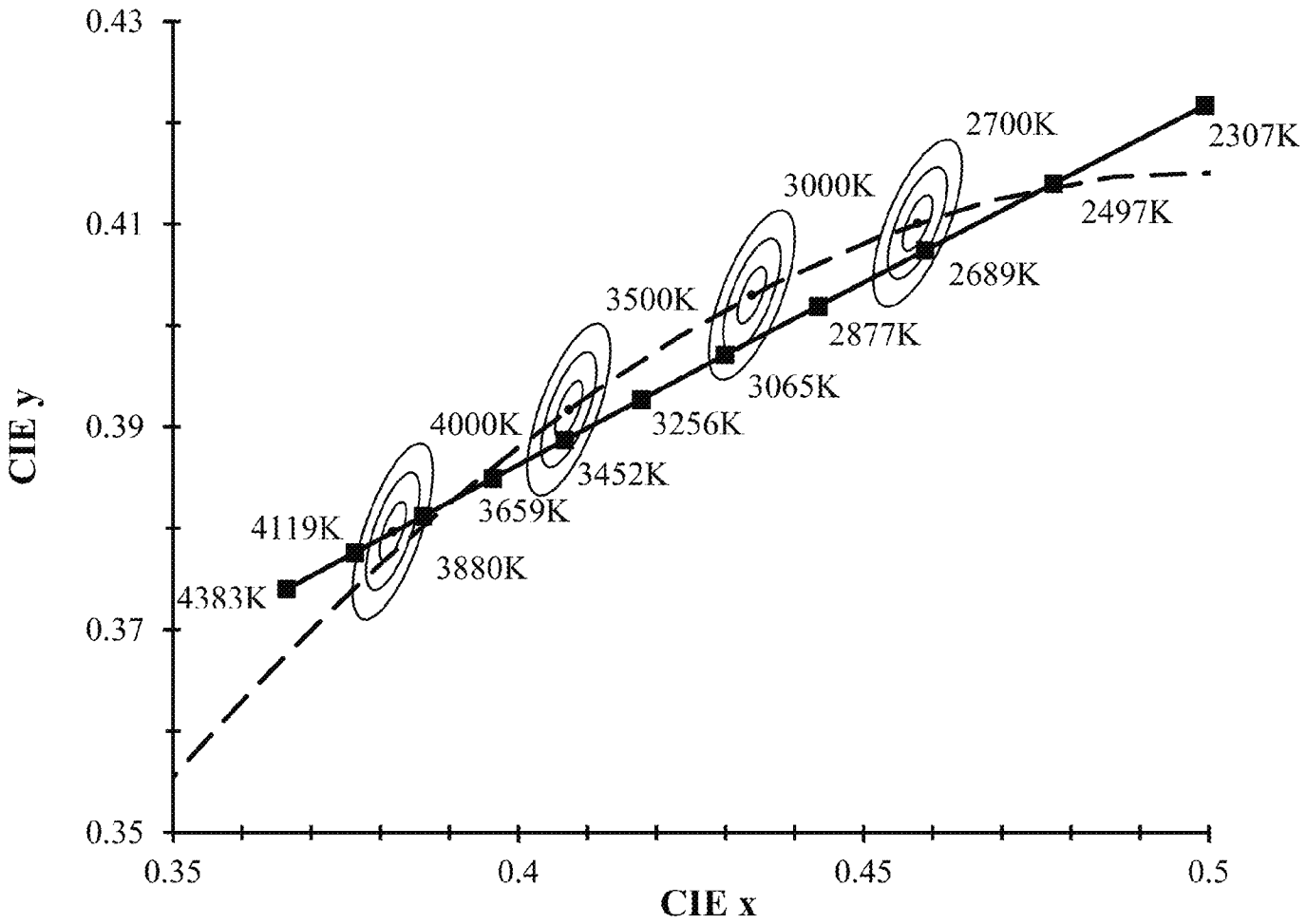
FIG. 4 shows a CIE diagram that illustrates dimming and how light emission over the full temperature range lies within 5 McAdam ellipse of the black body curve.

FIG. 4 shows a CIE diagram that illustrates dimming of the inventive light, and which shows how light emission over the full temperature range (i.e. cool white to warm white) lies within 5 McAdam ellipse of the black body curve.

Figure 5:
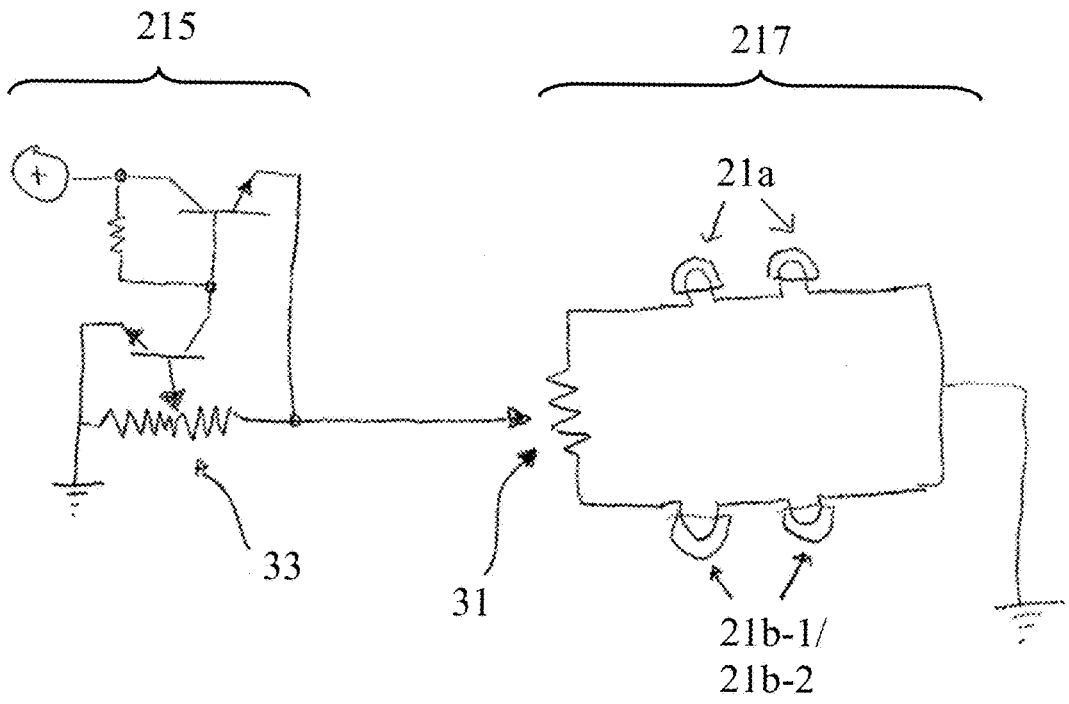
FIGS. 5, 6, and 7 illustrate example control circuitry that may be used to control the color temperature of the lighting device.

FIG. 5 shows a schematic representation of a driver circuit for operating the dimmer switch 215 and control circuit 217 of the linear light emitting device according to some embodiment of the invention.

The dimmer switch portion 215 of the driver circuit comprises a potentiometer/variable resistor 33 for controlling the relative amount of power to be applied to the LED arrays. The output voltage to be applied to the control circuit 217 therefore controls the brightness of the LED arrays. A second potentiometer/variable resistor (not shown) can be added in series with potentiometer/variable resistor 33, where one provides coarse resolution adjustment and the other provides finer resolution adjustments.

The control circuit 217 comprises a variable resistor 31 $R_w$ for controlling the relative drive currents $I_A$ and $I_B$ to the first and second LED arrays 21*a* and 21*b*-1/21*b*-2. The LEDs of each of the first and second LED arrays 21*a* and 21*b*-1/21*b*-2 are connected in series and the LED arrangements connected in parallel to the variable resistor 31. The variable resistor 31 is configured as a potential divider and is used to select the relative drive currents $I_A$ and $I_B$ to achieve a selected correlated color temperature (CCT).

Figure 6:
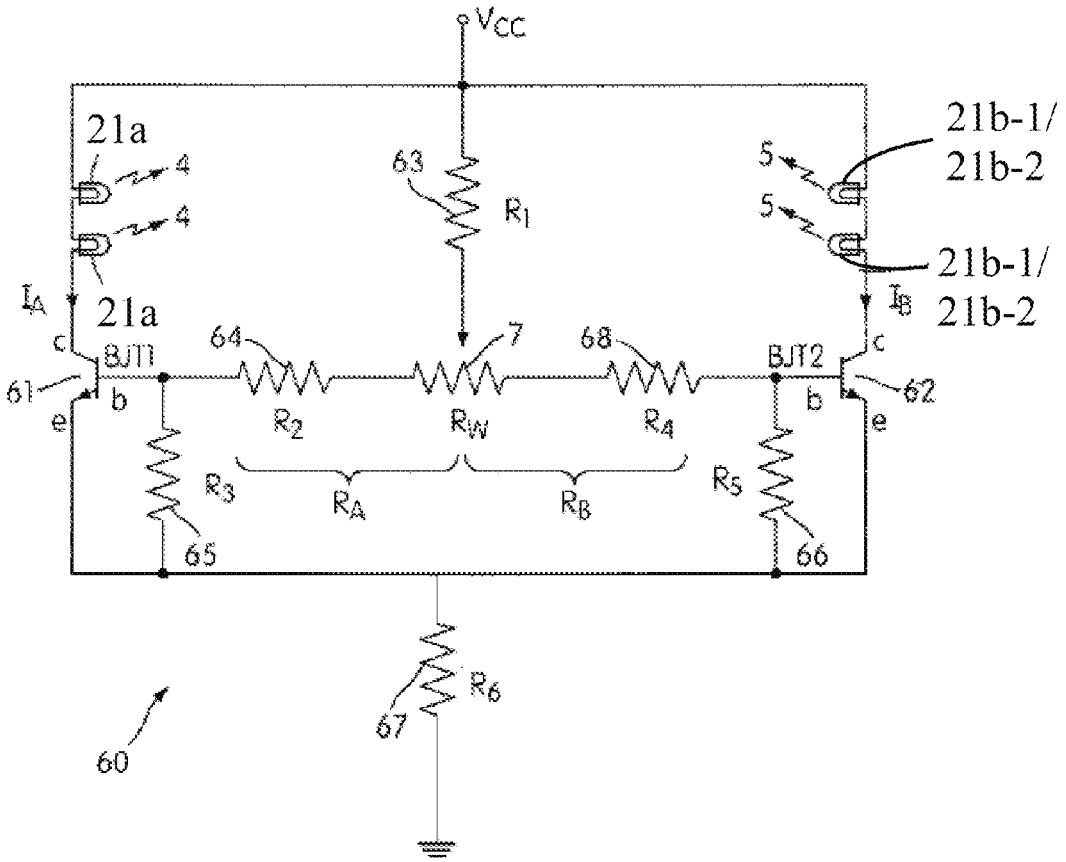

FIG. 6 shows another example of a driver circuit 60 for operating the linear light emitting device to control color temperature outputs, and which can also be used in conjunction with the dimmer switch circuit 215 that was previously described for FIG. 5. The driver circuit 60 comprises a respective bipolar junction transistor BJT1, BJT2 (61, 62) for operating each of the first and second LED arrays 21*a* and 21*b*-1/21*b*-2 and a bias network comprising resistors $R_1$ to $R_6$, denoted 63 to 68, respectively, for setting the dc operating conditions of the transistors 61, 62. The transistors 61, 62 are configured as electronic switches in a grounded-emitter e configuration. The first and second LED arrangements are serially connected between a power supply $V_{CC}$ and the collector terminal c of their respective transistor. The variable resistor $R_W$ 7 is connected between the base terminals b of the transistors and is used to set the relative drive currents $I_A$ and $I_B$ (where $I_A$=$I_{ce}$ of BJT1 and $I_B$=$I_{ce}$ of BJT2) of the first and second LED arrays 21*a* and 21*b*-1/21*b*-2 and hence color temperature of the source by setting the relative voltage $V_{b1}$ and $V_{b2}$ at the base of the transistor. The control voltages $V_{b1}$ and $V_{b2}$ are given by the relationships:

$$V_{b1} = \left[\frac{R_A + R_1}{R_A + R_1 + R_3 + R_6}\right]V_{CC} \text{ and}$$

$$V_{b2} = \left[\frac{R_B + R_1}{R_B + R_1 + R_5 + R_6}\right]V_{CC}.$$

As an alternative to driving the LED arrangements with a dc drive current $I_A$, $I_B$ and setting the relative magnitudes of the drive currents to set the color temperature, the LED arrangements can be driven dynamically with a pulse width modulated (PWM) drive current $i_A$, $i_B$.

Figure 7:
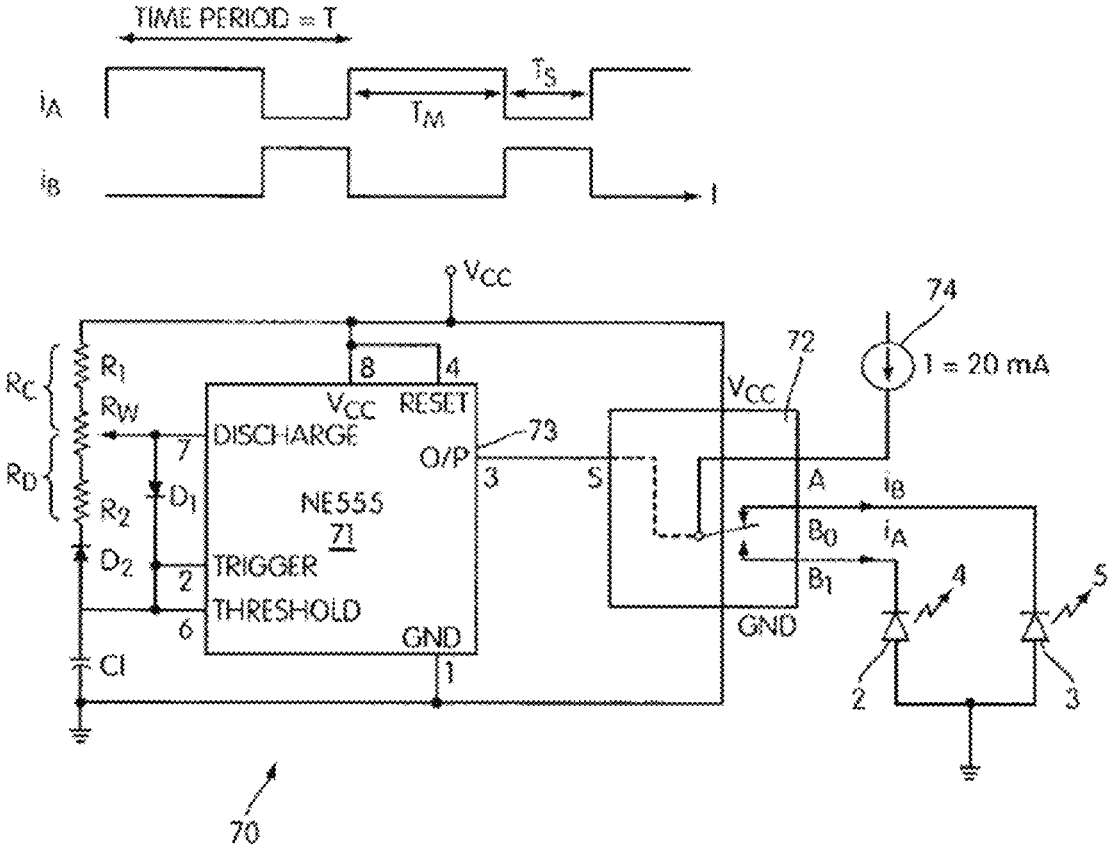

FIG. 7 illustrates a PWM driver circuit operable to drive the two LED arrangements on opposite phases of the PWM drive current (that is $i_B=\overline{i_A}$), and which can also be used in conjunction with a dimmer switch. The duty cycle of the PWM drive current is the proportion of a complete cycle (time period T) for which the output is high (mark time $T_m$) and determines how long within the time period the first LED arrangement is operable. Conversely, the proportion of time of a complete time period for which the output is low (space time $T_s$) determines the length of time the second LED arrangement is operable. An advantage of driving the LED arrangements dynamically is that each is operated at an optimum drive current though the time period needs to be selected to prevent flickering of the light output and to ensure light emitted by the two LED arrangements when viewed by an observer combine to give light which appears white in color.

The driver circuit 70 comprises a timer circuit 71, for example an NE555, configured in an astable (free-run) operation whose duty cycle is set by a potential divider arrangement comprising resistors $R_1$, $R_W$, $R_2$ and capacitor C1 and a low voltage single-pole/double throw (SPDT) analog switch 72, for example a Fairchild Semiconductor™ FSA3157. The output of the timer 73, which comprises a PWM drive voltage, is used to control operation of the SPDT analog switch 72. A current source 74 is connected to the pole A of the switch and the first and second LED arrays 21*a* and 21*b*-1/21*b*-2 connected between a respective output $B_0$ $B_1$ of the switch and ground. In general the mark time $T_m$ is greater than the space time $T_s$ and consequently the duty cycle is less than 50% and is given by:

$$\text{Duty cycle (without signal diode } D_1) = \frac{T_m}{T_m + T_s} = \frac{R_C + R_D}{R_C + 2R_D}$$

where $T_m$=0.7 ($R_C$+$R_D$) C1, $T_s$=0.7 $R_C$ C1 and T=0.7 ($R_C$+2$R_D$) C1.

To obtain a duty cycle of less than 50% a signal diode $D_1$ can be added in parallel with the resistance $R_D$ to bypass $R_D$ during a charging (mark) part of the timer cycle. In such a configuration the mark time depends only on $R_C$ and C1 ($T_m$=0.7 $R_C$ C1) such that the duty cycle is given:

$$\text{Duty cycle (with signal diode } D_1) = \frac{T_m}{T_m + T_s} = \frac{R_C}{R_C + R_D}.$$

Figure 8A:
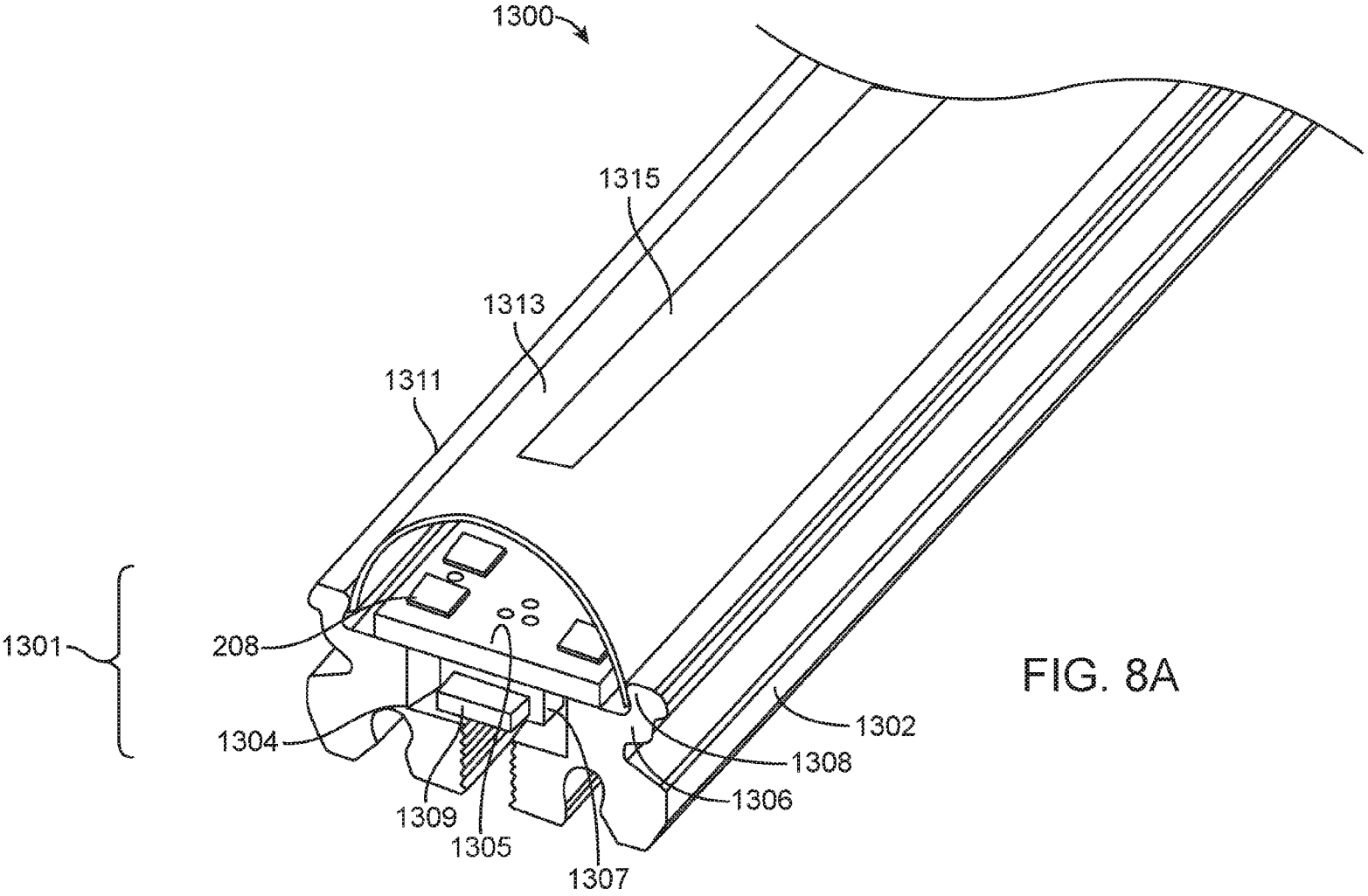
FIGS. 8A-B illustrate another example of an application of a linear lighting device in accordance with some embodiments.
Figure 8B:
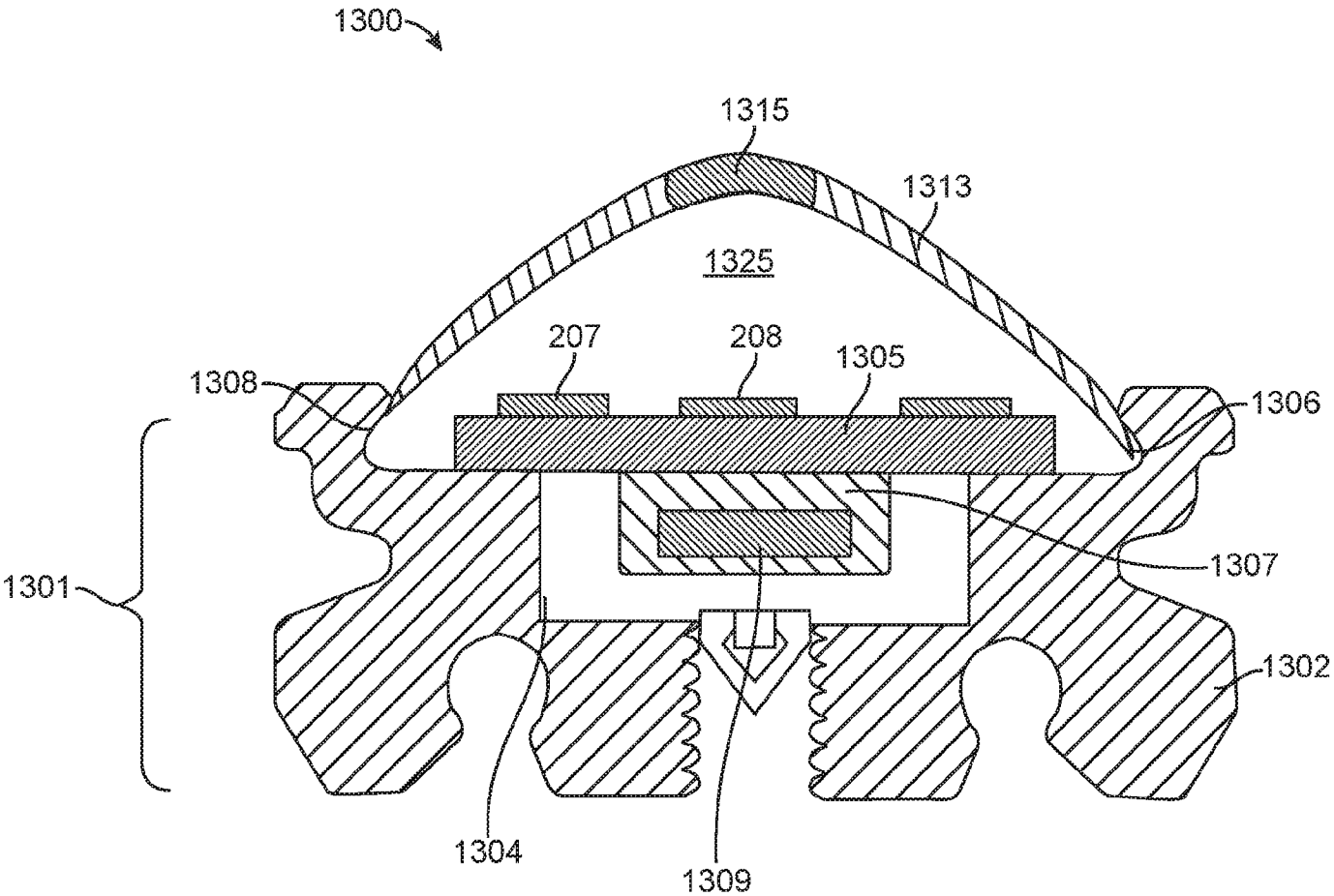

FIGS. 8A and 8B illustrate another example of an application of a wavelength conversion component in accordance with some embodiments. FIGS. 7A and 7B illustrate an LED linear lamp 1300 in accordance with some embodiments. FIG. 7A is a three-dimensional perspective view of the linear lamp 1300 and FIG. 7B is a cross-sectional view of the linear lamp 1300. The LED linear lamp 1300 is intended to be used as an energy efficient replacement for a conventional incandescent or fluorescent tube lamp.

The linear lamp 1300 comprises an elongated thermally conductive body 1301 fabricated from, for example, die cast aluminum. The form factor of the body 1301 is configured to be mounted with a standard linear lamp housing. The body 1301 further comprises a first recessed channel 1304, wherein a rectangular tube-like case 1307 containing some electrical components (e.g., electrical wires) of the linear lamp 1300 may be situated. The case 1307 may further comprise an electrical connector 1309 (e.g., plug) extending past the length of the body 1301 on one end, and a recessed complimentary socket (not shown) configured to receive a connector on another end. This allows several linear lamps 1300 to be connected in series to cover a desired area. Individual linear lamps 1300 may range from 1 foot to 6 feet in length.

The body 1301 functions as a heat sink and dissipates heat generated by the light emitters 207, 208, such as those described above. To increase heat radiation from the linear lamp 1300 and thereby increase cooling of the light emitters 207, 208, the body 1301 can include a series of heat radiating fins 1302 located on the sides of the body 1301. To further increase heat radiation from the linear lamp 1300, the outer surface of the body 1301 can be treated to increase its emissivity such as for example painted black or anodized.

Light emitters 207, 208 are mounted on a strip (rectangular shaped) MCPCB 1305 configured to sit above the first recessed channel 1304. The under surface of the MCPCB 1305 sits in thermal contact with a second recessed channel 1306 that includes inclined walls 1308.

A generally hemi-spherical elongate wavelength conversion component 1311 may be positioned remote to the light emitters 1307. The wavelength conversion component 1311 may be secured within the second recessed channel 1306 by sliding the wavelength conversion component 1311 under the inclined walls 1308 such that the wavelength conversion component 1311 engages with inclined walls 1308. The wavelength conversion component 1311 may also be flexibly placed under the inclined walls 1308 such that the wavelength conversion component 1311 engages with the inclined walls 1308.

The wavelength conversion component 1311 may include a first region 1315 comprising a first photo-luminescent material and a second region 1313 comprising a second photo-luminescent material. The first region 1315 may be located at the center of the wavelength conversion component 1311 and the second region 1313 may be located around the first region 1315. The first region 1315 may include photo-luminescent material configured to generates light ($\lambda_2$) with a CCT corresponding to a warm yellowish white and the second region 1313 may include photo-luminescent material configured to generate light ($\lambda_3$) with a CCT corresponding to a cool blueish white. The CCT of the emission product of the linear lamp 1300 is thus a combination of the CCT of the light generated by the light emitters 207, 208 ($\lambda_1$), the CCT of the light ($\lambda_2$) generated by the first region 1315, and the CCT of the light ($\lambda_3$) generated by the second region 1313.

The light emitters 207, 208 may be configured such that a first set of light emitters 207 corresponds to the first region 1315 and a second set of light emitters 208 correspond to the second region 1313. The linear lamp 1300 may further comprise a control circuit (not shown) configured to translate output power of a dimmer switch into a corresponding on/off configuration of the light emitters 207, 208. Thus by configuring the control circuit of the linear lamp 1300 to translate output power of the dimmer switch into a corresponding on/off configuration of the light emitters 207, 208, the linear lamp 1300 may be tuned like a typical incandescent light bulb, as discussed above.

In alternative embodiments, the wavelength conversion component of the linear lamp may be configured in the shape of a generally planar strip. In such embodiments, it will be appreciated that the second recessed channel may instead have vertical walls that extend to allow the wavelength conversion component to be received by the second recessed channel.

Therefore, what has been described is an improved approach to implement a linear lighting device that can be controlled for dimming levels in conjunction with color temperature levels. The embodiments of the present invention provide at least two remote phosphor sources can be tuned to be on the black body curve, allowing a blends of these the colors to be very stable and where the blending at different relative levels travels along a 2D line that runs parallel to the black body curve. This allows both dimming and corresponding color temperatures to be tuned at the different dimming levels. In addition, the current approach allows color control and corresponding electronics to be much simpler for this architecture since it does not require a 3D color table (as would be required by RGB systems). A significant benefit with the current approach is that is with proper electronics control it is possible to have very dim or very bright cool white or warm white. In some embodiment, dimming and color can be controlled independently using this approach.

In some embodiment, the arrays of LEDs are all selected to have the same color (e.g., blue LEDs). Because all of the LEDs would be the same color (e.g., blue), this makes the electronics much simpler to implement (e.g., because they can be drive with the same voltages and drive conditions). Another benefit pertains to the use of remote phosphor, which allows for improved light uniformity and "fill" without excessive pixelation. There is also the benefit of simplicity of manufacturing. This could be manufactured by combining multiple extrusions together or by a single 4 material extrusion.

Any number of different phosphor regions can be provided in the integrated wavelength conversion component. The above embodiments describe three regions, having a central warm white color and two outer regions have the same cool white color. Some embodiments can be implemented that only use two rows of remote phosphor (side by side, each one different colors). This approach can be implemented with a relatively a deeper mixing chamber to avoid color separation side to side (warm side, cool side when both sources are on), although perceptible optical effects of having just the two sets of phosphor regions may cause this embodiment to be more appropriate for indirect lighting applications. In contrast, the described approach having symmetric regions (e.g., one central cool region and two outer warm regions) provides relatively more symmetrical light when blending warm and cool white cools, and thus may be more suitable for direct lighting applications. Some embodiments may provide even more regions of different phosphors/colors, e.g., to provide different levels of colors and/or color temperatures.

In the foregoing specification, the disclosure has been described with reference to specific embodiments thereof. It will, however, be evident that various modifications and changes may be made thereto without departing from the broader spirit and scope of the disclosure. The specification and drawings are to be regarded in an illustrative sense rather than in a restrictive sense.

What is claimed is:

1. A light arrangement, comprising:

an elongated solid-state light source having multiple elongate arrays of solid-state light emitters; and a hollow elongated optical component having an interior volume, the hollow elongated optical component comprising multiple wavelength conversion regions having a first region that corresponds to a first color temperature and a second region that corresponds to a second color temperature, the first region corresponding to a first elongated array of solid-state light emitters and the second region corresponding to a second elongated array of solid-state light emitters;

wherein the multiple wavelength conversion regions project into the interior volume of the hollow elongated optical component;

wherein an emission product of the light arrangement is a combination of first region emissions generated by the first region, second region emissions generated by the second region, and light source emissions generated by the elongated solid-state light source; and wherein the elongated optical component is an integrally formed component having the multiple wavelength conversion regions and a diffuser portion.

2. The light arrangement of claim 1, wherein the multiple wavelength conversion regions and the diffuser portion are co-extruded portions.

3. The light arrangement of claim 1, wherein second region comprises two portions, and the first region is located at the center of the elongated optical component between the two portions of the second region.

4. The light arrangement of claim 1, wherein light generated by the first region is warm white and light generated by the second region is cool white.

5. The light arrangement of claim 1, wherein a control circuit proportionally applies power to the multiple elongated arrays of solid-state light emitters to dim the light emitting device.

6. The light arrangement of claim 1, further comprising a reflector portion having a light reflective material.

7. The light arrangement of claim 1, wherein the elongated optical component comprises the diffuser portion having a light diffusive material.

8. The light arrangement of claim 7, wherein the light diffusive material comprises at least one of zinc oxide, titanium dioxide, barium sulfate, magnesium oxide, silicon dioxide or aluminum oxide.

9. The light arrangement of claim 1, further comprising: a control circuit to control distribution of power to the multiple elongated arrays of solid-state light emitters.

10. The light arrangement of claim 9, wherein the control circuit is operable to change relative contributions of the first and second regions to light emissions by the light arrangement, such that an overall color temperature of the light arrangement changes in response to dimming of the light arrangement.

11. The light arrangement of claim 10, wherein the light arrangement comprises a dimmer switch and a color temperature control circuit, and the dimmer switch and the color temperature control circuit correspond to separate control mechanisms.

12. The light arrangement of claim 10, wherein the light arrangement comprises a dimmer switch and a color temperature control circuit, and a single control mechanism is provided that controls both the dimmer switch and the color temperature control circuit.

13. A hollow optical component having an interior volume, comprising:

a first elongated wavelength conversion region having a first composition of photo-luminescent materials; and a second elongated wavelength conversion region having a second composition of photo-luminescent materials;

wherein the first and second elongated wavelength conversion regions project into the interior volume of the hollow optical component;

wherein the first composition of photo-luminescent materials and the second composition of photo-luminescent materials generate light having different color temperatures; and wherein the first elongated wavelength conversion region, the second elongated wavelength conversion region, and a diffuser portion are integrally formed.

14. The optical component of claim 13, wherein the second elongated wavelength conversion region comprises two portions, and the first elongated wavelength conversion region is located between the two portions of the second elongated wavelength conversion region.

15. The optical component of claim 13, wherein light generated by the first elongated wavelength conversion region is warm white and light generated by the second elongated wavelength conversion region is cool white.

16. The optical component of claim 13, wherein the diffuser portion comprises a light diffusive material.

17. The optical component of claim 16, wherein the light diffusive material comprises at least one of zinc oxide, titanium dioxide, barium sulfate, magnesium oxide, silicon dioxide or aluminum oxide.

* * * * *